US006832055B2

(12) United States Patent
Ochiai

(10) Patent No.: US 6,832,055 B2
(45) Date of Patent: Dec. 14, 2004

(54) IMAGE RECORDING MEDIUM REPRODUCTION APPARATUS AND METHOD FOR REMOVING IMAGES FORMED ON AN IMAGE RECORDING MEDIUM

(75) Inventor: Norikazu Ochiai, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/370,734

(22) Filed: Feb. 24, 2003

(65) Prior Publication Data

US 2004/0165918 A1 Aug. 26, 2004

(51) Int. Cl.[7] ..... G03G 15/00; G03G 15/04; G03G 15/22; B08B 3/00

(52) U.S. Cl. ..... 399/1; 134/122 R; 399/390

(58) Field of Search ..... 399/1, 341, 343, 399/390, 411; 430/97; 134/15, 122 R, 122 P

(56) References Cited

U.S. PATENT DOCUMENTS 5,353,108 A * 10/1994 Tsukamoto ..... 399/390
5,463,447 A * 10/1995 Kurotori et al. ..... 399/1
5,619,765 A * 4/1997 Tokita et al. ..... 134/122 R X
5,678,158 A * 10/1997 Kurotori et al. ..... 399/390
5,689,754 A * 11/1997 Yoshida et al. ..... 399/1
5,736,286 A * 4/1998 Kaneko et al. ..... 430/97
5,813,216 A * 9/1998 Hoshiba et al. ..... 134/122 R X
6,080,255 A * 6/2000 Shinkai et al. ..... 134/15 X

FOREIGN PATENT DOCUMENTS

JP 7-92866 A 4/1995

* cited by examiner

*Primary Examiner*—Sandra Brase
(74) *Attorney, Agent, or Firm*—Foley & Lardner LLP

(57) ABSTRACT

An image recording medium reproduction apparatus of the present invention comprises: a conveying member to convey an image recording medium in a prescribed direction, which is made of a material preventing the penetration of an image into it; and an image separation member that contacts the image recording medium conveyed to the conveying member and rotates in the same direction as the prescribed direction by maintaining a speed difference with the image recording medium at the contacting point and removes the image formed on the surface of the image recording medium by rubbing it.

4 Claims, 1 Drawing Sheet

IMAGE RECORDING MEDIUM REPRODUCTION APPARATUS AND METHOD FOR REMOVING IMAGES FORMED ON AN IMAGE RECORDING MEDIUM

BACKGROUND OF THE INVENTION

1. Field of the Invention

The present invention relates to an image recording medium reproduction apparatus for removing images formed on such an image recording medium as coating paper and the like and reproducing the image recording medium for reuse and an image recording medium reproducing method.

2. Description of the Related Art

It is desired that image recording medium with images formed thereon by such image forming apparatus as printers, copying machines or facsimile, etc. are reused for effective utilization of resources after finishing a function as an information recording medium. Therefore, a reproduction apparatus was so far developed to reproduce paper having a toner image formed on the surface by making the toner image wet using surface active agent, heating and removing toner from the paper by attaching it on an offset belt surface as disclosed in Japanese Patent Application No. 7-92866.

However, in the above-mentioned conventional reproduction apparatus, a toner image formed on the surface of a recording medium is attached on an offset belt and separated. Accordingly, depending on kind of toner/paper, etc., a toner image may remain on the surface of a recording medium after removed on the offset belt and the recording medium may become unsuitable for reuse. In particular, in the case of OHP sheets made of plastic film, plastic coated paper to prevent penetration of toner/ink into the inside of paper, adherence of toner/ink to paper is strong depending on toner/ink and images cannot be removed from the surface of paper.

From the above, in the case of plastic film coated paper for preventing toner/ink from penetrating into the sheet, it is demanded to reuse paper by clearly removing image formed thereon after completing the function as an information recording medium for the effective use of resources and it is desired to obtain a highly reliable image recording medium reproduction apparatus that is capable of surely removing images on the surfaces of recording media.

SUMMARY OF THE INVENTION

An object of the present invention is to enable reuse of image recording medium irrespective of material of toner/ink by removing images formed on image recording medium clearly against the adhesion to the surfaces of image recording medium to achieve the effective use of resources.

According to the embodiments of the present invention, a recording medium reproduction apparatus is provided. This apparatus comprises: a conveying member to convey an image recording medium made of a material to prevent an image from penetrating into the inside having an image formed on the surface in the prescribed direction and an image separation member that contacts an image recording medium being conveyed on the conveying member, rotates in the same direction as the prescribed conveying direction at the contacting position by maintaining a speed difference with an image recording medium and scrapes off an image formed on the surface of an image recording medium.

Further, according to the embodiments of the present invention, an image recording medium reproduction method is provided. This image recording medium reproduction method comprises: a first step to convey image recording medium made of a material to prevent penetrating of an image into the inside of the paper in a prescribed direction; and a second step to separate an image formed on the image recording medium by rubbing it by an image removing member by rotating in the same direction as the prescribed direction.

DETAILED DESCRIPTION OF THE EMBODIMENTS

Preferred embodiments of the present invention will be explained below in detail referring to the attached drawings.

Figure 1:
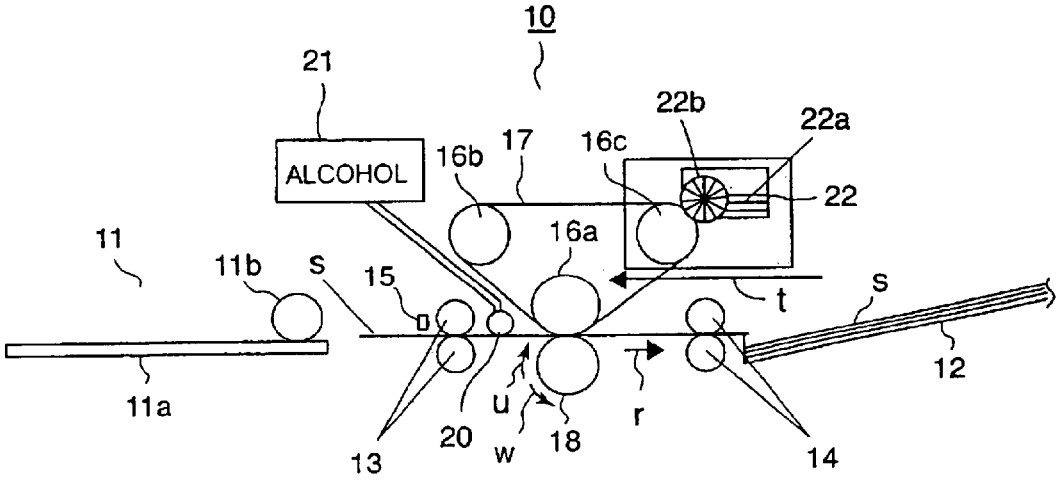
FIG. 1 is a schematic construction diagram showing a sheet reclaiming apparatus in a first embodiment of the present invention.

FIG. 1 is a schematic construction diagram showing a sheet reproduction apparatus 10 that is an image recording medium reproduction apparatus. The sheet reproduction apparatus 10 has a paper feed tray 11*a* for placing sheets S, a paper feeding portion 11 having a pickup roller 11*b* to pick up sheets S that are image recording media, and a discharged sheet receiving tray 12 to place sheets S after the reproduction process. Sheets S are used image recording sheets after forming toner images thereon by an image forming apparatus such as a printer, a copying machine, etc. and used as information recording media and require removal of images for the purpose of reuse. Here, sheets S are OHP sheets coated with, for example, a transparent plastic film.

Between the paper feed portion 11 and the discharged paper receiving portion 12, there are provided a first conveying roller pair 13 that is an upper stream conveying member to convey a sheet S in the direction of the discharged sheet receiving tray that is a prescribed direction and a second conveying roller pair 14 that is a downstream conveying member. A sheet S is clamped at the front end and the rear end by the first conveying roller pair 13 and the second conveying roller pair 14 and conveyed in the arrow direction r at a speed of v1. At the upper stream of the first conveying roller pair 13, a switch 15 is provided to detect the passage of the sheet S.

Between the first conveying roller pair 13 and the second conveying roller pair 14, there are a removing belt 17 and a facing roller 18, that are image removing members stretched among a backup roller 16*a*, driving roller 16*b* and a tension roller 16*c*. The removing belt 17 is rotated by the driving roller 16*b* in the arrow direction t at a speed v2 which is two times of the sheet S conveying speed v1. The removing belt 17 clamps a sheet S conveyed by the first and second conveying roller pairs 13 and 14 jointly with the facing roller 18 and removes an image formed on the surface of the sheet S by rubbing it at the position to contact the sheet S.

The facing roller 18 is made of, for example, ethylene propylene rubber (DPDM), etc. and when the front end of a sheet S is inserted into the contacting point with the removing belt 17, rotates in the arrow direction t of the removing belt 17 without having a driving force or in the arrow direction u that is the same as the conveying direction of sheet S in the arrow direction r by the first and the second conveying roller pairs 13 and 14.

When the switch 15 detects that the sheet S is separated from the first conveying roller pair 13 by detecting the rear end of the sheet S, the facing roller 18 is inversely driven in the arrow direction w that is the inverse direction to the sheet S conveying direction. However, when the facing roller 18 is inversely rotating in the arrow direction w, the rear end of the sheet S is free from the first conveying roller pair 13 but the front end of the sheet S is conveyed in the arrow direction r at a speed v1 by the second conveying roller pair 14.

When the facing roller 18 is inversely rotating in the arrow direction w, the sheet S is conveyed at the speed v1 in the arrow direction r regardless of the inverse rotation of the facing roller 18 when the conveying force of the sheet S by the second conveying roller pair 14 is made larger than the clamping force of the sheet S by the removing belt 17 and the facing roller 18. On the other hand, a friction resistance is so set that the sheet conveying force by the facing roller 18 becomes larger than the conveying force of the sheet S by the removing belt 17. As a result, even when the removing belt 17 is rotating in the arrow direction t at the speed v2, the sheet S is pulled in the direction inverse to the arrow direction r and conveyed while pulled each other without deflecting at the contacting position between the second conveying roller pair 14 and the removing belt 17.

Further, an alcohol coating roller 20 is a solvent supply member to supply liquid alcohol that is a solvent to a sheet S at the upper stream of the removing belt 17. Required amount of alcohol is constantly supplied from an alcohol container 21. When a liquid alcohol is coated on a sheet S by the alcohol coating roller 20, a toner image on the surface of sheet S is dissolved in the liquid alcohol and becomes easily removable by rubbing. Therefore, the removing belt 17 is made with a non-woven fabric made of cotton or Teflon fabric or wool fiber so as to easily take images formed in toner or ink dissolved in liquid alcohol in the fabric by removing the surface of sheet S.

Further, in order to increase affinity of the removing belt 17 with toner/ink, a material of the same system as toner/ink may be used for the removing belt 17, for example, polyester resin, polyethylene terephthalate (PET), etc. and adherence of the removing belt 17 with images is set stronger than that of sheet S with images and images dissolved in liquid alcohol are removed by attaching on the removing belt 17.

At the downstream of the contacting position of the removing belt 17 with sheet S, there is provided a cleaner 22 to clean the removing belt 17 with a brush roller 22*b* immersed in a cleaning liquid 22*a* to remove toner taken in the removing belt 17.

Next, the operation of the apparatus will be described. Sheet S that completes the function as an information recording medium and requires the reproduction process is taken out by the pickup roller 11*b* from the paper supply tray 11*a* to the first conveying roller pair 13. Then, the sheet S is conveyed by the first conveying roller pair 13 at the speed v1 in the arrow direction r, that is, the direction of the discharged paper receiving tray 12. Further, when the switch 15 detects the front end of the sheet S, the removing belt 17 rotates in the arrow direction t at the speed v2. At this time, the facing roller 18 is driven in the arrow direction u following the removing belt 17.

Then, after coated with liquid alcohol on the surface by the alcohol coating roller 20, the sheet S is inserted between the removing belt 17 and the facing roller 18. At this time, the removing belt 17 is rotating in the same direction as the sheet S conveying direction and the facing roller 18 is also driven in the arrow direction u following the removing belt 17 and the front end of the sheet S is smoothly inserted without disturbed by the removing belt 17 or the facing roller 18. Between the removing belt 17 and the facing roller 18, the surface of the sheet S is rubbed by the removing belt 17 rotating at a speed of two times of the sheet S conveying speed and a toner image on the surface of the sheet S is wiped off on the removing belt 17 side. At this time, a toner image is dissolved in liquid alcohol and easily wiped off by the removing belt 17. The toner wiped off is taken in fabrics of the removing belt 17 and the toner image is clearly removed from the surface of the sheet S.

When the switch 15 detects the passage of the rear end of the sheet S and the sheet S passes through the first conveying roller 13, the facing roller 18 is driven inversely in the arrow direction w. As a result, irrespective of the rear end becoming free from the first conveying roller pair 13, until the rear end passes the contacting position with the removing belt 17, the sheet S is conveyed in the arrow direction r at the v1 speed while pulling each other between the second conveying roller pair 14 and the removing belt 17 by the friction resistance of the facing roller 18. Therefore, even after the rear end of the sheet S passed the first conveying roller pair 13, the surface of the sheet S is rubbed by the removing belt 17 and a toner image is removed clearly from the whole surface of the sheet S and a good reproduction process is obtained.

Thereafter, the sheet S is discharged on the discharged sheet receiving tray 12 and the reproduction process is terminated. On the other hand, the removing belt 17 that took toner in the fiber is cleaned by removing the toner with a brush roller 22*b* of the cleaner 22 and becomes ready for the next image removing operation. When the removing belt 17 is extremely contaminated by performing the sheet S reproduction process in order, remove and clean the removing belt 17, and again install it among the backup roller 16*a*, the driving roller 16*b* and the tension roller 16*c* or replace it with a new belt.

According to this first embodiment, as a toner image on the surface of a sheet S is removed by rubbing with the removing belt 17, even if the adherence of a toner image with a sheet S is somewhat high, a toner image on the surface of a sheet S is clearly removed to the removing belt by force without leaving a toner image on the surface of a sheet S. Thus, a sheet S becomes reusable and the effective use of resources is achieved. Furthermore, a toner image is dissolved in liquid alcohol by supplying liquid alcohol on the surface of a sheet S by the alcohol coating roller 20 before rubbing off a toner image by the removing belt 17 and therefore, it becomes easy to rub off a toner image by the removing belt 17 and it becomes possible to surely remove a toner image from the surface of a sheet S in the reproduction process.

Further, when the rear end of a sheet S passes the first conveying roller pair 13 and becomes free, the facing roller 18 rotates in the inverse direction and a sheet S is conveyed between the second conveying roller 14 and the removing belt 17 in the state wherein it is pulled each other by them at the contacting point, and a sheet S is rubbed to the last of the rear end and the whole surface can be reproduced satisfactorily. Further, the removing belt 17 rotates in the same direction as the sheet S conveying direction at two times speed by maintaining the speed difference with the sheet S. Therefore, the front end of the sheet S can be smoothly inserted between the removing belt 17 and the facing roller 18.

Figure 2:
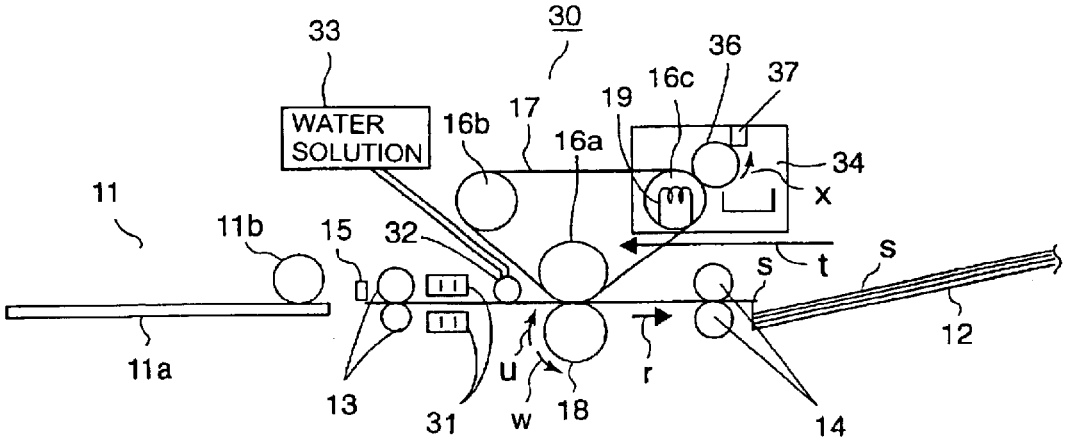
FIG. 2 is a schematic construction diagram showing a sheet reproduction apparatus in a second embodiment of the present invention.

Next, a second embodiment of the present invention will be described. This second embodiment differs from the first embodiment in that a toner image is rubbed off by heating a sheet S in the first embodiment and the structure of a cleaner is different. Therefore, the same component elements explained in the first embodiment will be assigned with the same reference numerals and the detailed explanation thereof will be omitted in this second embodiment. From the first conveying roller pair 13 to the removing belt 17 of a second sheet reproduction apparatus 30 shown in FIG. 2, a pair of upper and lower heaters 31 is provided as heating members to heat a sheet S. As a result of this heating, a toner image on a sheet S is dissolved and easily taken in the fibers of the removing belt 17.

Further, a water solution coating roller 32 is a solvent supply member to supply water solution containing a surface active agent as an assistant to a sheet S, and water solution containing a required amount of surface active agent is supplied constantly from a water solution container 33. When a water solution containing surface active agent is coated on a sheet S by the water solution coating roller 32, a toner image on the surface of the sheet S is further dissolved in the water solution and is easily rubbed off by the removing belt 17.

Further, a cleaner 34 dissolves toner attached on the removing belt 17 by the tension roller 16*c* having the heater 19 and attach the dissolved toner to a fluoric resin coated metallic roller 36. The cleaner 34 has a cleaning blade 37 comprising a silicon rubber, etc. to scrape off toner attached on the surface of the metallic roller 36.

When a sheet S is put on the paper supply tray 11*a* and conveyed in the arrow direction r at the speed v1 by the first conveying roller pair 13, the sheet S is heated by the heater 31 and a toner image on its surface is dissolved. Further, water solution containing a surface active agent is coated on the surface, the sheet S is inserted between the removing belt 17 and the facing roller 18 in the state wherein the toner image on the surface is dissolved in the water solution containing surface active agent.

Between the removing belt 17 and the facing roller 18, the surface of a sheet S is rubbed by the removing belt 17, and a toner image is heated, fused, and dissolved in water solution containing surface active agent that is an assistant and is extremely easily wiped off on the removing belt 17. Thus, the toner image on the surface of a sheet S is clearly removed. The facing roller 18 acts similarly in the first embodiment until the front end of a sheet S is inserted between the removing belt 17 and the facing roller 18 and the rear end of a sheet S passes the contacting position with the removing belt 17. Therefore, in the reproduction processing, a sheet S is inserted smoothly between the removing belt 17 and the facing roller 18 and the surface is rubbed by the removing belt 17 to the last even at the rear end and a toner image is removed satisfactorily. Thereafter, a sheet S with the toner image removed is discharged on the discharged sheet receiving tray 12 and the reproduction process is completed.

The toner wiped off from the surface of a sheet S by the removing belt 17 is taken in the fiber of the removing belt 17. The toner taken in the fiber of the removing belt 17 is removed by the adherence of a metallic roller 36 of the cleaner 34 rotating in the arrow direction x, and the removing belt 17 becomes ready for the next toner image removing operation. The toner adhered to the metallic roller 36 is scraped off in the cleaner 34 by the cleaning blade 37.

According to the second embodiment, likewise the first embodiment, disregarding adhesion between a toner image and a sheet S, a toner image formed on the surface of a sheet S can be wiped off forcibly by rubbing with the removing belt 17 and the entire surface of a sheet S is reproduced satisfactorily. Accordingly, it becomes possible to reuse a sheet S and devise the effective use of resources. Furthermore, as a toner image on the surface of a sheet S is dissolved by heating with the heater 31 before rubbing it off, it becomes easier to rub off a toner image by the removing belt 17. Further, in this embodiment, a heated and dissolved toner image is further dissolved using a solvent containing surface active agent as an assistant, a toner image can be rubbed off more effectively and it becomes possible to remove a toner image certainly from the surface of a sheet S in the reproduction processing.

Further, this invention is not limited to the above-mentioned embodiments but can be modified variously within the scope thereof. For example, an image recording medium that is an object of the reproduction process can be plastic coated paper provided that toner/ink, etc. that are image forming agents do not penetrate into the inside or plastic filmed turbid sheets used for OHP but colored or white turbid sheets as desired. Further, rotational speeds or rotational directions of the image separation member are not restricted when it has a speed difference from image recording media. However, when the image separating member is rotated in the direction inverse to the conveying direction of an image recording medium, it becomes difficult to insert the front end of an image recording medium into the image separation member and it is therefore desired that the image separation member rotates in the same direction as the image recording medium conveying direction until the front end of an image recording medium is at least secured by a conveying member at the downstream side.

Further, the structure of the reproduction apparatus is also not limited. For example, in the first embodiment, when liquid alcohol is coated on a sheet S, liquid alcohol is not applied directly to a sheet S by the alcohol coating roller but liquid alcohol may be supplied to the removing belt 17, the surface of a sheet S is rubbed by the removing belt 17 and at the same time, a toner image is dissolved by alcohol and then, the toner image may be wiped off.

Also, in the second embodiment, instead of preheating a sheet S by a heater but a heater may be built in the backup roller 16*a* of the removing belt 17, and by heating the removing belt 17 and rubbing the surface of a sheet S by the removing belt 17 and at the same time, a toner image may be heated and dissolved and then, wiped off. Also, a solvent that is supplied as an assistant in the second embodiment can be water, aqueous solution containing water-soluble polymer, etc.

Further, in the above-mentioned embodiments, after the rear end of a sheet S passed the first conveying roller pair, the facing roller 18 opposing to the removing belt 17 is controlled to rotate in the inverse direction and the sheet S is conveyed by pulling it each other by the contacting point of the second conveying roller pair 14 and the removing belt 17 at their contact point. However, a sheet S may be conveyed by gripping its rear end in the state where it is pulled each other by the second conveying roller pair 14 and the grip.

As described above, according to the present invention, images formed on image recording media are wiped off by rubbing the image recording media with the image separation member in the reproduction processing of image recording media and it becomes possible clearly remove images formed on image recording media and reuse the image recording media.

What is claimed is:

1. An image recording medium reproduction apparatus comprising:

a conveying member to convey from an upper stream side to a downstream side an image recording medium that is made of a material into which the image formed on the surface is not penetrated in a prescribed direction;

an image separation member between the upper stream side and the downstream side, the image separation member being in contact at a contacting position with the image recording medium conveyed on the conveying member, rotates in the same direction as the prescribed direction by maintaining a speed difference with the image recording medium at the contacting position and rubs off the image formed on the surface of the image recording medium;

a heating member provided at the upper stream side from the image separation member to heat and dissolve the image formed on the surface of the image recording medium; and a solvent supply member provided at the upper stream side from the image separation member to supply solvent to the image formed on the surface of the image recording medium.

2. An image recording medium reproduction apparatus comprising:

a conveying member to convey an image recording medium that is made of a material into which the image formed on the surface is not penetrated in a prescribed direction; and an image separation member provided that is in contact with the image recording medium conveyed on the conveying member, rotates in the same direction as the prescribed direction by maintaining a speed difference with the image recording medium at the contacting position and rubs off the image formed on the surface of the image recording medium, wherein the conveying member comprises an upper stream conveying member arranged at the upper stream in the prescribed direction via the image separation member and a downstream conveying member arranged at the downstream in the prescribed direction, there is provided a facing roller that is facing to the image separation member and conveys the image recording medium by clamping jointly with the image separation member at the contacting position, rotates in the same direction as the prescribed direction while the image recording medium is passing the upper stream conveying member, and rotates in the inverse direction to the prescribed direction when the rear end of the image recording medium comes off the upper stream conveying member, and when the facing roller is rotating in the inverse direction, a conveying force of the image recording medium by the facing roller is larger than that of the image recording medium by the image separation member, and a conveying force of the image recording medium by the downstream conveying member is larger than a clamping force of the image recording medium by the facing roller.

3. An image recording medium reproduction method comprising:

conveying from an upper stream side to a downstream side an image recording medium having an image in a material not penetrating in the inside and formed on the surface in the prescribed direction;

contacting the image recording medium that is being conveyed at a contacting position between the upper stream side and the downstream side with the image recording medium while maintaining a speed difference with the image recording medium and rubbing off the image formed on the surface of the image recording medium by an image separation member rotating in the same direction as the prescribed direction;

heating and dissolving the image formed on the surface of the image recording medium at the upper stream side; and supplying solvent to the image formed on the surface of the image recording medium at the upper stream side.

4. An image recording medium reproduction method comprising:

conveying an image recording medium having the image in a material not penetrating in the inside and formed on the surface in the prescribed direction;

contacting the image recording medium that is being conveyed at the contacting position with the image recording medium while maintaining a speed difference with the image recording medium and rubbing off the image formed on the surface of the image recording medium by an image separation member rotating in the same direction as the prescribed direction, wherein the conveying is executed using an upper stream conveying member arranged at the upper stream in the prescribed direction via the image separation member and a downstream conveying member arranged at the downstream in the prescribed direction, the contacting and rubbing are executed using the image separation member and a facing roller to clamp and convey the image recording medium at a contacting position, the facing roller is rotated in the same direction as the prescribed direction while the image recording medium is passing the upper stream conveying member in the contacting and rubbing, and when the rear end of the image recording medium goes away from the upper stream conveying member in the contacting and rubbing, the facing roller rotates in the inverse direction to the prescribed direction so that a conveying force of the image recording medium by the facing roller becomes larger than that of the image recording medium by the image separation member and a conveying force of the image recording medium by the downstream conveying member becomes larger than a clamping force of the image recording medium by the image separation member and the facing roller.

* * * * *